United States Patent [19]

Anderson et al.

[11] 4,194,590

[45] Mar. 25, 1980

[54] LOUDSPEAKER HORN WITH ADJUSTABLE ANGLE OF DISPERSION

[75] Inventors: C. Roger Anderson, Wilmette; Robert B. Schulein, Evanston, both of Ill.

[73] Assignee: Shure Brothers, Incorporated, Evanston, Ill.

[21] Appl. No.: 29,612

[22] Filed: Apr. 13, 1979

[51] Int. Cl.[2] ..... G10K 11/00

[52] U.S. Cl. ..... 181/186

[58] Field of Search ..... 181/185, 186, 187, 188, 181/197, 159, 195

[56] References Cited

U.S. PATENT DOCUMENTS

| | | | |
|---|---|---|---|
| 986,908 | 3/1911 | Cobb | 181/186 |
| 1,506,393 | 8/1924 | Thomas | 181/186 |

FOREIGN PATENT DOCUMENTS

| | | | |
|---|---|---|---|
| 220041 | 3/1910 | Fed. Rep. of Germany | 181/186 |
| 206750 | 8/1939 | Switzerland | 181/186 |

*Primary Examiner*—Stephen J. Tomsky

*Attorney, Agent, or Firm*—Allegretti, Newitt, Witcoff & McAndrews

[57] ABSTRACT

A loudspeaker horn, which is divided into three segments, is provided with a valve for projecting sound either through the central segment or through all of the segments, said valve being adjustable from the front of the loudspeaker by a knob which has markings thereon to indicate the position of the valve and which is provided with means for retaining it in the position set by the knob.

3 Claims, 6 Drawing Figures

LOUDSPEAKER HORN WITH ADJUSTABLE ANGLE OF DISPERSION

BACKGROUND OF THE INVENTION

Loudspeakers or sound amplifying devices have been heretofor known in which the loudspeaker is divided into a number of segments for dispersing the sounds emanating from the loudspeaker to various portions of a room or auditorium. It is also known to provide valve means for determining which segments of the speaker are to convey the sound from the source thereof which is usually directed to a throat of the speaker which is in turn connected with the various horn segments. Furthermore, the prior art contains devices for adjusting the aforementioned valve.

A rotatable valve V is shown in Thomas U.S. Pat. No. 1,506,393 and is operated by a lever extending to the side thereof to control the acoustical connection to the inner horn and the outer horn 1. Rotatable valve elements also are shown in the horn of Cobb U.S. Pat. No. 986908 and in Swiss Pat. No. 206750 (1939). However, none of the prior art patents disclose an adjustment for a speaker comprising a central horn and two adjacent horns and wherein an adjustment extends forwardly from the horns exteriorly thereof to a position to adjust a valve to provide for the souond passing only through the center horn or alternatively through the center horn and the two outer horns.

DESCRIPTION OF THE PREFERRED EMBODIMENT

Figure 1:
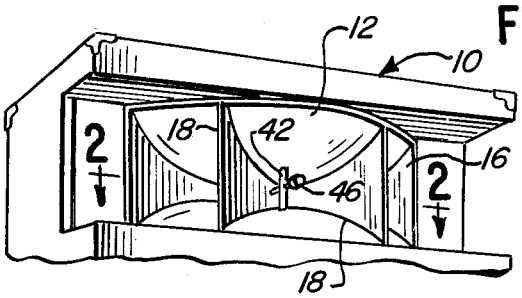
FIG. 1 is a perspective view of a sond projection unit with loudspeaker horn.

FIG. 1 shows a perspective view of a sound projection unit 10 which supports a loudspeaker horn assembly 12 thereon. The loudspeaker horn assembly 12, shown in FIG. 2, includes a throat 20 and a mounting portion 14 at the base thereof for connection to the sound source and from which extend walls 16 which are diverging from the center of the speaker at an angle of 120°. In addition, walls 18 are provided and diverge at a 60° angle from each other and at a 30° angle from each of the walls 16. The loudspeaker horns therefore provide for dispersion of sound either at angles of 60° or 120° depending upon the position of a valve member.

Figure 3:
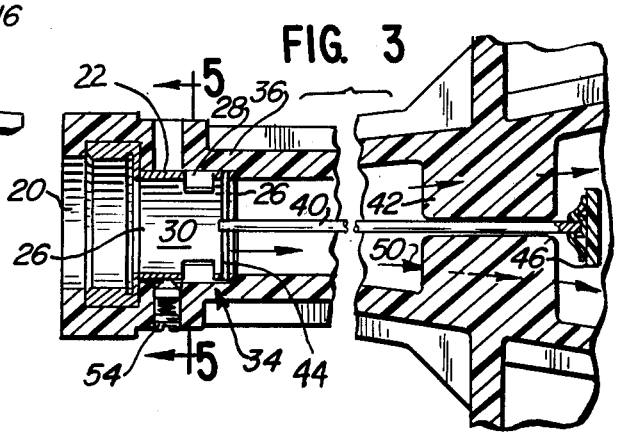
FIG. 3 is an enlarged partial sectional view of the valve for adjusting the path of the sound in the loudspeaker horn and is taken on line 3—3 of FIG. 2.
Figure 4:
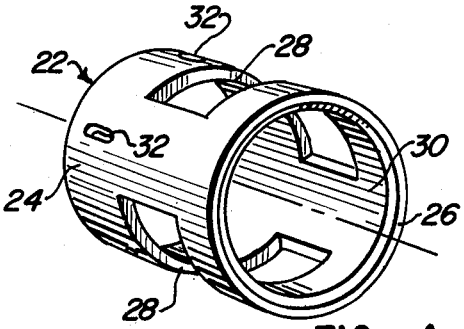
FIG. 4 is a perspective view of the tubular portion of the sound controlling valve.

The valve member 22, as best shown in FIG. 4, comprises a tubular wall portion 24 preferably formed of metal which is provided with open ends 26. The tubular wall portion 24 is provided with coutouts 28 which alternate open and solid portions 30 around the circumference of the valve member 22. A number of detent depressions 32 are provided on the outside surface of the tubular wall portion 24, so that a detent ball plunger shown at 54 in FIG. 3 will engage with one of the detent depressions 32 shown in FIG. 4 and maintain the valve member 22 in the position that it is set, in a manner hereinafter described.

Figure 5:
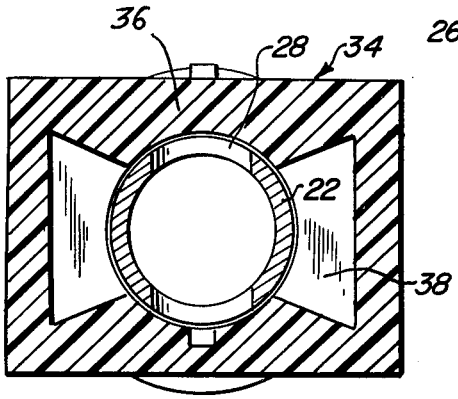
FIG. 5 is a sectional view taken on line 5—5 of FIG. 3.
Figure 6:
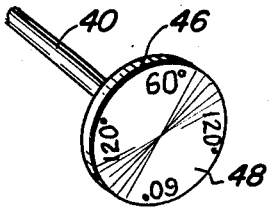
FIG. 6 is a perspective view of the adjusting knob shown in FIGS. 1, 2 and 3.

In FIG. 5, number 34 designates a housing for valve member 22 which is provided with a closed portion 36 and with horizontally extending openings 38. The valve member 22 fits snugly into the supporting member 34 but is readily rotatable therein as shown in FIG. 3 by rotating a rod 40 which is supported at 42 from the loudspeaker assembly and which is provided with a knob 46 having a face 48 as shown in FIG. 6 which has indications thereon to show the position of the valve, such as for example "60°" and "120°." The rod 40 is attached to a pin 44, as best shown in FIG. 3, which is in turn attached to the valve member 22 so that when the knob 46 is rotated the rod 40 rotates pin 44 and the entire valve member 22. In FIG. 4, pin 44 and rod 40 are omitted to show detail.

Figure 2:
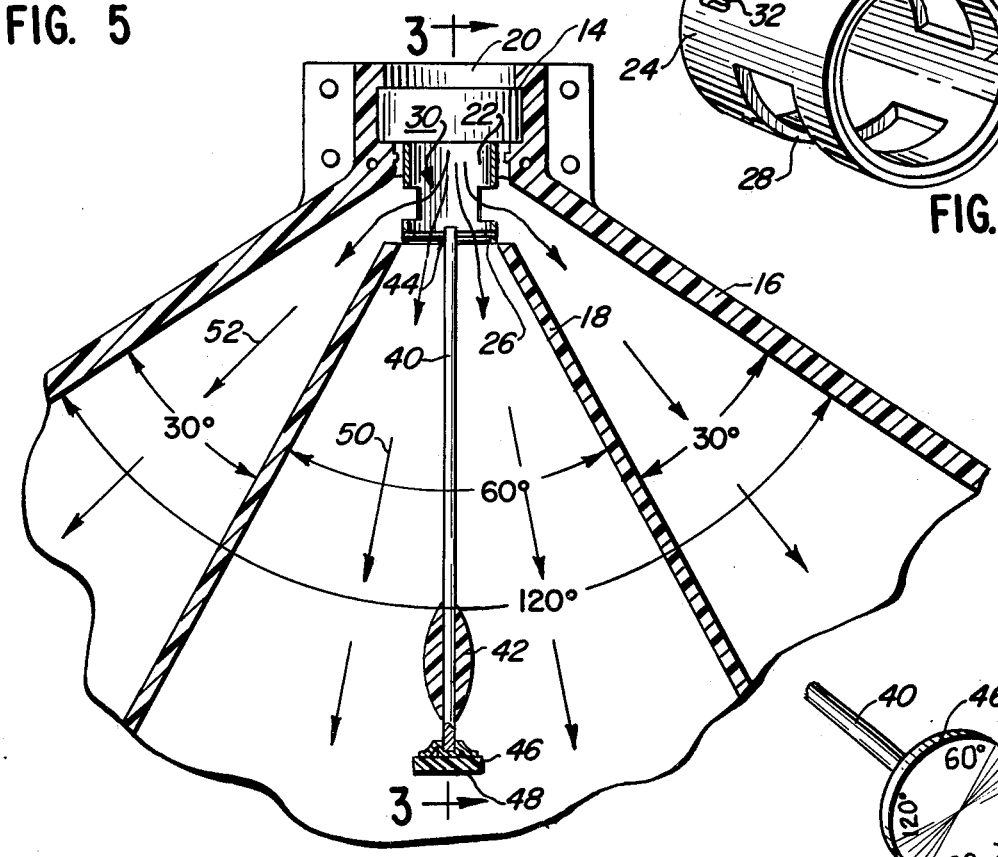
FIG. 2 is a sectional view of the loudspeaker horn, taken on line 2—2 of FIG. 1.

The horn walls, throat and assembly are preferably formed from a suitable thermoplastic material. The valve member 22 may be rotated so that the openings 28 are as shown in FIG. 2 wherein the sound waves from the throat 20 are directed through both the 60° horn and the 120° horn as shown by the sound indicating arrows 50 and 52 in FIG. 2. However, if the knob 46 is turned to the 60° angle indication, the valve member 22 is rotated so that it is in the position shown in FIGS. 3 and 5 in which case the housing 34 or the portion 36 thereof blocks the sound waves from passing through the openings 28 in the valve member 22 and therefore sound waves pass only through the 60° horn as shown by the arrows 50 in FIG. 3.

The position of the knob 46 in either the 60° angle sound dispersion position or the 120° angle sound dispersion position is retained in the position desired by engagement of the detent ball plunger 54 with proper depression 32 in the tubular wall portion 24.

From the foregoing it will be apparent that we have provided for an improved loudspeaker construction in which the sound emanating therefrom may be readily varied in the amount of dispersion from the sound projection unit by rotating a knob which is accessible from the front of the horn and which is provided with indications thereon so that the operator may readily determine and accomplish the sound dispersion which is desired.

What is claimed is:

1. Loudspeaker horn means, including means for adjusting the angles of sound dispersion therefrom, said loudspeaker horn means including a center segment and two outer segments disposed at each side of the center segment, a plurality of walls forming said segments with the wall of the center segment forming one of the walls of the two side segments and independent walls forming the outer sides of the two side segments, said horn including a throat through which sound is directed, said walls forming outer sides said side segments extending to and joining with said throat with the walls of the center segment spaced from the throat, said adjusting means comprising a valve including an open-ended tube with a pair of openings formed in the sides thereof and connecting the walls of the center segment with said throat, said valve including means for rotatably supporting the tube and for blocking said openings therein from communication between the throat and the two side segments of the horn when in one position and at the same time providing communication between the throat and the center segment thereof; and providing communication between said throat and all of the segments of the horn when in another position, and means for rotating the valve to the desired position comprising a rod extending outwardly through the center segment of the horn and connected at its inner end to said tube and to an adjusting knob at its outer end.

2. Loudspeaker horn means as claimed in claim 1 wherein means are provided for retaining the tube in the position placed by the rotation of the knob assembly.

3. Loudspeaker horn means as claimed in claim 1 wherein markings are placed on the knob to indicate position of the valve.

* * * * *